United States Patent [19]

Robinson et al.

[11] Patent Number: 4,723,670

[45] Date of Patent: Feb. 9, 1988

[54] PUMP CLOSURE FOR CARBONATED BEVERAGE CONTAINER

[76] Inventors: Tommy R. Robinson, 3532 Miller Park Dr.; Michael B. Beyer, 2924 Southern Cross La., both of Garland, Tex. 75042

[21] Appl. No.: 929,591

[22] Filed: Nov. 12, 1986

Related U.S. Application Data

[63] Continuation-in-part of Ser. No. 828,542, Feb. 12, 1986, abandoned.

[51] Int. Cl.[4] ..... B65D 51/24

[52] U.S. Cl. ..... 215/228

[58] Field of Search ..... 215/228, 260; 53/88

[56] References Cited

U.S. PATENT DOCUMENTS

| | | | |
|---|---|---|---|
| 3,557,986 | 1/1971 | Poole | 215/37 |
| 3,602,387 | 8/1971 | Patnaude et al. | 215/228 |
| 3,853,222 | 12/1974 | Helms | 206/315 |
| 4,033,091 | 7/1977 | Saponara | 53/88 |
| 4,287,819 | 9/1981 | Emerit | 99/472 |
| 4,524,877 | 6/1985 | Saxby et al. | 215/228 |

FOREIGN PATENT DOCUMENTS 1019450 1/1953 France .

*Primary Examiner*—Donald F. Norton

*Attorney, Agent, or Firm*—Dennis T. Griggs

[57] ABSTRACT

A hand-operated pump is combined with a closure cap for sealing and pressurizing the open space within a carbonated beverage container. A pump cylinder is integrally formed with a closure screw cap and is insertable through the neck of the beverage container. A piston is coupled by a retainer ring for extension and retraction through the pump cylinder. The piston carries a floating seal which is axially movable along a reduced diameter portion of the piston for opening and closing an air inlet port between an air supply annulus and a compression chamber. The pump includes an improved check valve assembly in which a compressed air discharge port is sealed by a resilient membrane which engages a tapered sealing surface which is coincident with the compressed air discharge port.

6 Claims, 5 Drawing Figures

PUMP CLOSURE FOR CARBONATED BEVERAGE CONTAINER

CROSS REFERENCE TO RELATED APPLICATION

This application is a continuation-in-part of pending application Ser. No. 06/828,542 filed Feb. 12, 1986, now abandoned.

FIELD OF THE INVENTION

This invention relates generally to closures for beverage containers, and in particular to a screw cap closure having a pump for pressurizing a beverage container with ambient air.

BACKGROUND OF THE INVENTION

Carbonated beverages are sold in glass and plastic containers which are pressurized and then sealed by original factory closures. The purpose of the closure is to seal the container and maintain the contents under pressure until the container is opened for dispensing the beverage. Some beverage containers are relatively small, in the six- to ten-ounce range, and are sealed by a disposable cap which is discarded after the beverage container is opened. Larger beverage containers, for example in the two- to three-liter range, are provided with re-usable screw cap closures for resealing the container after a portion of the beverage has been served.

Carbonated beverages typically contain dissolved carbon dioxide gas which will escape into the atmosphere unless the container is pressurized and sealed. The flavor of such carbonated beverages turns flat in the absence of the dissolved carbon dioxide gas. The loss of carbonation can be reduced somewhat by sealing the beverage container after use. However, because of the relatively large volume of some beverage containers, the carbonization will be released into the sealed open space within the container, with the result that the flavor of the remaining beverage is impaired. Accordingly, the quality of the beverage in such larger containers will gradually deteriorate, with the result that a substantial portion of the beverage will become unpalatable, and will be discarded.

DESCRIPTION OF THE PRIOR ART

The practice of sealing the open volume within the beverage container to reduce the rate of loss of carbonation from the beverage is commonly accepted. Closure devices having a resilient sealing member for insertion into and engaging the neck of the container have provided a secure seal for the interior volume of the container. However, as the amount of beverage remaining is reduced, the open space grows larger, and more and more of the dissolved carbonation is released from the beverage and into the open space.

It has also been recognized and demonstrated that if the open volume within the beverage container is repressurized with ambient air, the amount of dissolved carbon dioxide released from the beverage will substantially reduced. Pumping devices have been proposed for pressurizing the open volume within the container with ambient air. It is also known to combine a closure cap and pressurizing pump for insertion into the neck of a beverage container. Such prior art pressurizing and closure devices have failed in some instances to develop and maintain the pressure within the open volume of the beverage container at a level greater than the pressure of dissolved gases within the beverage. In some instances, such pump closure devices have been unable to develop a sufficiently high enough pressure within the container open space because of leakage through or around the sealing components of the pump. In other instances, the prior art pumping devices have developed adequate pressure levels initially, but were unable to maintain the interior pressure at the desired level because of leakage.

OBJECTS OF THE INVENTION

It is, therefore, the principal object of the present invention to provide an improved closure cap/pump combination for sealing and pressurizing a carbonated beverage container.

Another object of the invention is to provide an improved pump for pressurizing the interior of a container with ambient air.

Yet another object of the invention is to provide a closure cap/pump combination having improved sealing means for preventing back flow leakage during a pressurizing stroke.

A related object of the invention is to provide a closure cap/pump combination having improved sealing means for preventing the escape of gases out of the pressurized open space of a container after a desired pressure level has been achieved.

SUMMARY OF THE INVENTION

A hand-operated pump is combined with a closure cap for sealing and pressurizing the interior open space within a carbonated beverage container. A pump cylinder is integrally formed with a closure screw cap and is insertable into the open space of a beverage container, with the pump cylinder extending through the neck of the container. A piston is mounted by a guide ring for extension and retraction through the pump cylinder. The space between the piston and the inside bore of the cylinder sidewall constitutes an air supply annulus which is sealed by a resilient, annular seal carried by the piston and which engages the inner sidewall of the cylinder. The bore space on the opposite side of the seal constitutes a compression chamber.

According to an important feature of the invention, the annular seal is received about a reduced diameter portion of the piston, and is axially movable along the reduced diameter portion to a first position in which a vent groove formed on the piston is open for the admission of air from the air supply annulus into the compression chamber during up-stroke retraction of the piston. The annular seal is axially movable along the reduced diameter portion from the first position to a second position in which the seal engages the piston and seals the air supply annulus with respect to the vent groove as the piston and seal move through the pump cylinder during down-stroke movement, thereby permitting high compression levels to be established.

According to yet another feature of the invention, the pump cylinder is provided with an improved check valve assembly in which an outlet port is sealed by a resilient, conformable member which engages a tapered sealing surface formed within the cylinder sidewall in an area which is coincident with the outlet port. As a result of resilient flexure of the sealing member against the tapered sealing surface, the forces directed onto the sealing member during an up-stroke operation and at rest are uniformly distributed across the face of the member, thereby avoiding the creation of wrinkles which could compromise the seal. Moreover, during a down-stroke operation in which air is forced out of the compression chamber and into the open space of the beverage container, the resilient member is easily displaced away from the tapered surface surrounding the discharge port to permit the container open space to be pressurized.

The superior features and advantages of the present invention will be further appreciated by those skilled in the art upon consideration of the detailed description which follows with reference to the attached drawings.

DETAILED DESCRIPTION OF THE PREFERRED EMBODIMENT

Figure 2:
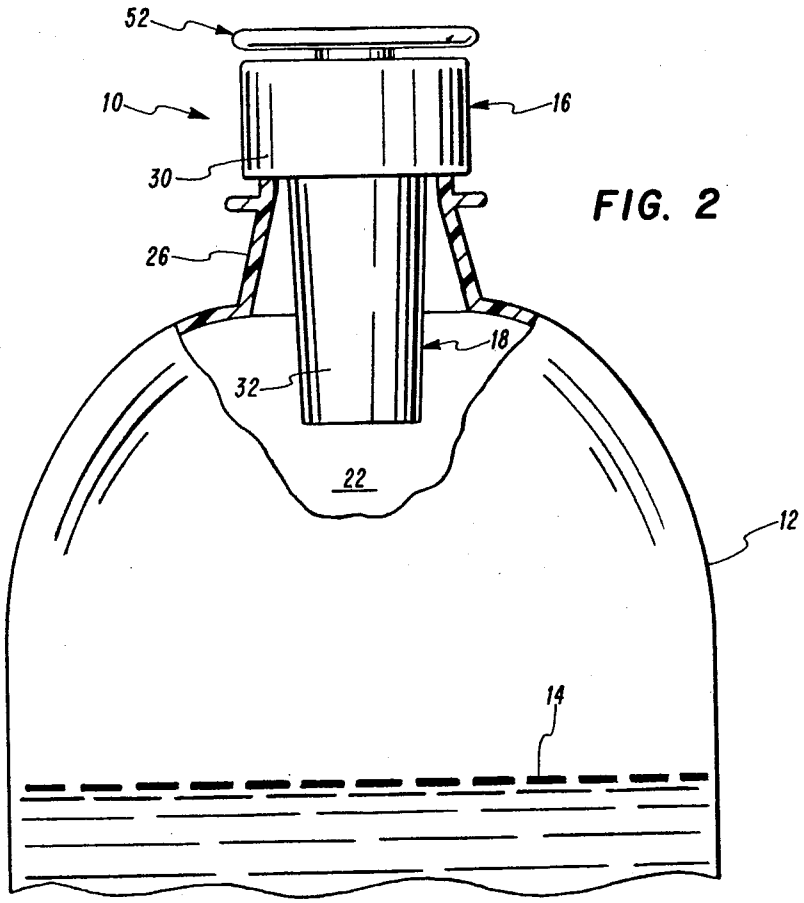
FIG. 2 is an elevation view, partially in section, of the closure cap/pump combination as fitted onto the neck of a carbonated beverage container.

In the description which follows, like parts are indicated throughout the specification and drawings with the same reference numerals, respectively. The drawings are not necessarily to scale and the proportions of certain parts have been exaggerated to better illustrate operation of the invention.

An improved closure cap/pump assembly 10 is provided for sealing a container 12 and for pressurizing a volume of carbonated beverage 14 which is enclosed within the beverage container 12. The assembly 10 includes a closure cap 16 to which a pump 18 is attached. The pump 18 includes a check valve 20 (FIG. 3) which permits ambient air to be pumped into the interior open space 22 of the beverage container 12, while substantially preventing the escape of pressurized gases from the open space 22 in the reverse direction through the pump 18.

The closure cap 16 is provided with threads 24 formed about the inside diameter of the closure cap 16 for engagement with complementary threads (not illustrated) formed about the external sidewall surface of the container neck 26. Compression engagement of the threads, together with the operation of the check valve 20, effectively seal the internal container space 22 to prevent the escape of pressurized gases.

The closure cap 16 is provided with a crown 28 and a cylindrical sidewall 30 integrally formed therewith. Also integrally formed with the crown 28 is a pump housing 32 which is concentrically located with respect to the cylindrical cap sidewall 30. The pump housing 32 is provided with a cylindrical bore 34 which extends through the crown 28. The cylindrical bore 34 is sealed at the opposite end of the pump housing 32 by the check valve assembly 20.

Ambient air is pumped into the interior open space 22 through the bore 34 of the pump 18. As can best be seen in FIG. 2, the closure cap 16 is screwed onto the container neck 26 with the pump housing 32 extending through the neck 26 in fluid communication with the container open space 22. When the closure cap 16 is tightly secured to the container neck 26, air discharged through the check valve 20 pressurizes the open space 22 within the container 12.

Figure 1:
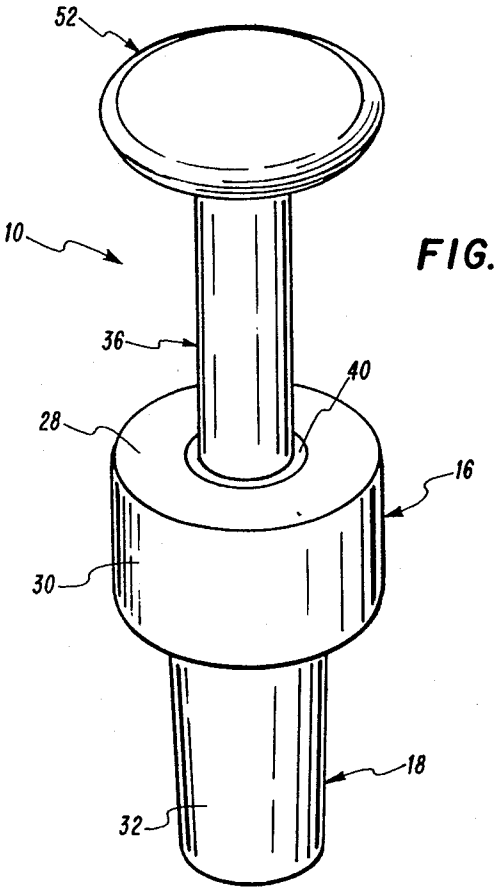
FIG. 1 is a perspective view of the closure cap/pump combination of the present invention.
Figure 3:
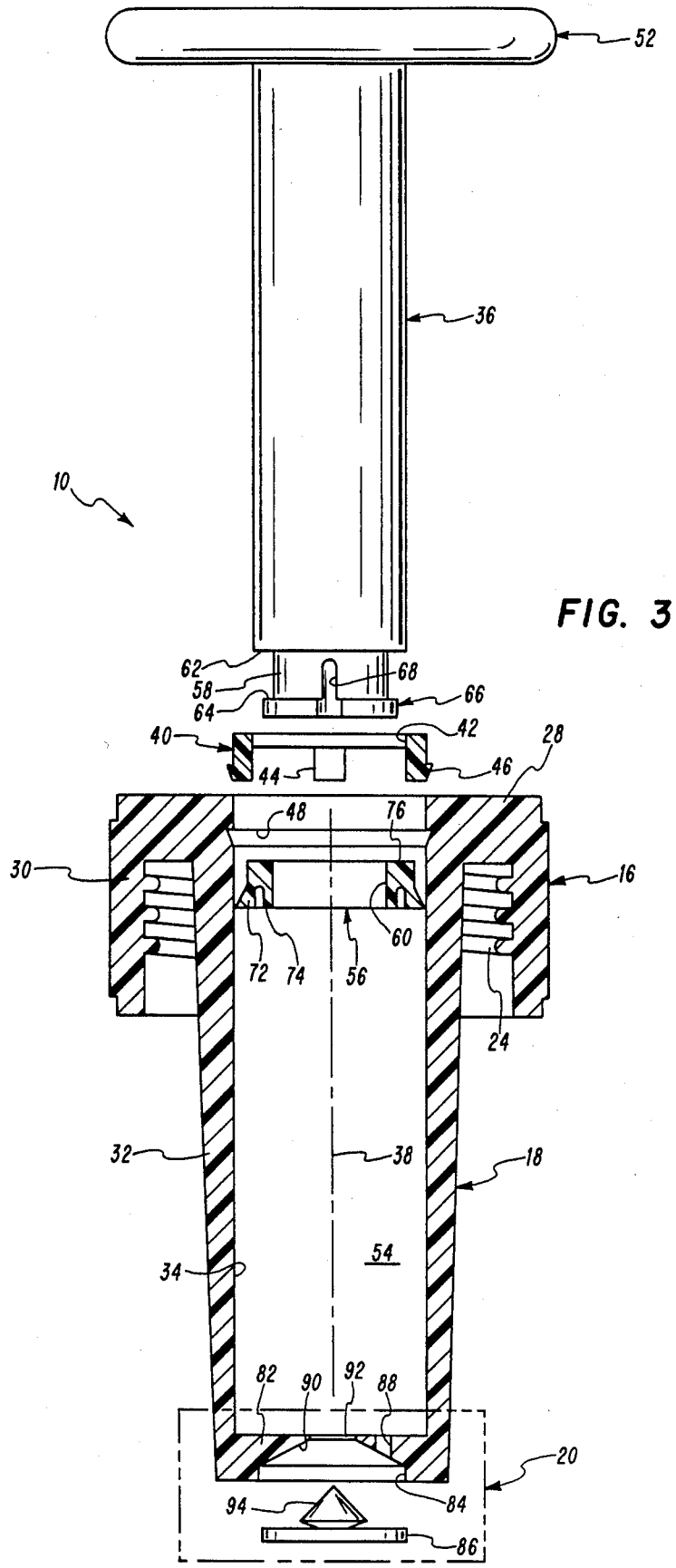
FIG. 3 is an exploded view, partly in section, of the closure cap/pump combination of the present invention.

Referring now to FIGS. 1 and 3, the pump 18 includes a piston 36 which is concentrically received within the cylindrical bore 34 for reciprocal axial movement in extension and retraction along the longitudinal axis 38 of the cylindrical bore 34. The piston 36 is centered within the bore 34 by an annular locator ring 40. The locator ring 40 is provided with a cylindrical bore 42 within which the piston 36 is slidably received. The locator ring 40 is coupled to the crown 28 by locking fingers 44 which carry radially-projecting, tapered shoulders 46. The tapered shoulders 46 are received within an annular groove 48 formed within the cylindrical bore 34 which extends through the crown 28. The annular groove 48 is tapered to accomodate the tapered shoulder 46 of the locking fingers 44. The locking fingers 44 are resilient and deflect radially inwardly as the locator ring 40 is inserted into the piston bore 34. The tapered shoulders 46 snap into engagement within the tapered groove 48, thereby forming an interlocking union.

The diameter of the pump piston 36 is appropriately sized to permit the piston to slip freely through the bore 42 of the locator ring 40. The piston 36 is radially spaced from the bore 34, thereby defining an air supply annulus 50. It will be appreciated that a small clearance exists between the external surface of the piston bore 36 and the surface of the locator bore 42, thereby defining an annular flow passage through which ambient air A can be drawn into the air supply annulus 50.

Pumping action is produced manually be extending and retracting the piston through the pump housing bore 34. The piston 36 is provided with a handle 52 for manually pushing the piston into and withdrawing it out of the pump housing bore 34. The pump housing bore 34 encloses a cylindrical compression chamber 54 through which ambient air is pumped from the surrounding environment into the interior open space 22 of the beverage container 12. The compression chamber 54 is axially bounded by an annular seal 56 which is movably mounted onto and carried by the piston 36.

In particular, the lower end of the piston 36 is provided with a reduced diameter portion 58 onto which the annular seal 56 is mounted. The annular seal 56 is provided with a bore 60 which is fitted for axial sliding movement along the external surface of the reduced diameter piston portion 58. Axial movement of the annular seal 56 relative to the piston 36 is limited in one direction by a radially-projecting shoulder 62, and is limited in the opposite direction by a radial shoulder 64 formed on a flange 66 which terminates the opposite end of the piston 36.

The locator ring 40 and the annular seal 56 cooperate to stabilize movement of the piston 36 through the piston bore 34.

Figure 4:
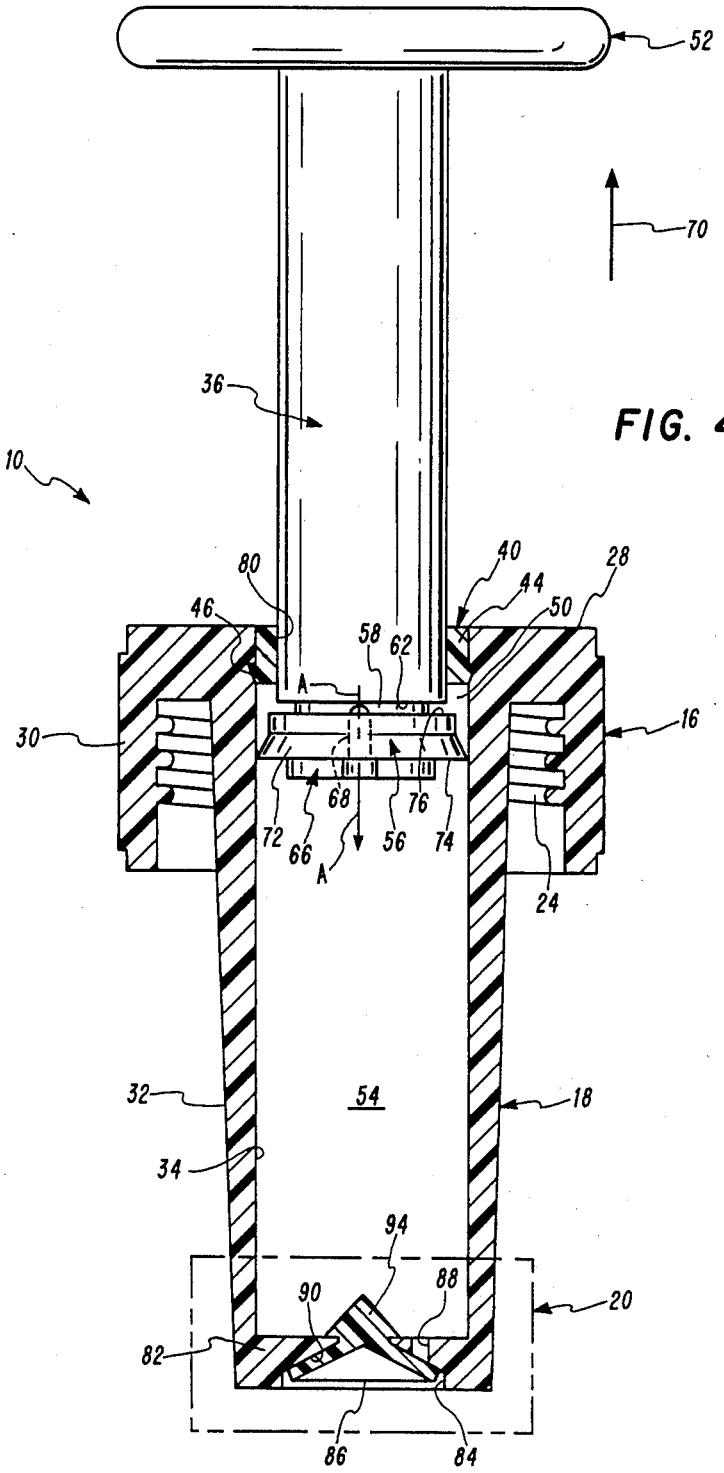
FIG. 4 is a sectional view of the closure cap/pump combination which illustrates the relationship of the pump components during an up-stroke operation; and, FIG. 5 is a view similar to FIG. 4 which shows the relationship of the pump components during a down-stroke operation.

A shallow groove 68 is formed in the reduced diameter piston portion 58 and extends through the flange 66, thereby providing a flow passage through which air A trapped within the air supply annulus 50 is vented into the compression chamber 54 as the piston 36 is extended out of the pump housing during up-stroke operation as indicated by the arrow 70 in FIG. 4.

The annular seal 56 "floats" with respect to the reduced diameter piston portion 58, whereby it is forced into engagement with the radial shoulder 64 of the flange 66 as the piston 36 is extended outwardly during an up-stroke operation, with the result that the inlet port 68 is opened to allow air A trapped in the air supply annulus 50 to be vented into the lower compression chamber 54. The annular seal 56 is provided with a tapered shoulder 72 which resiliently engages the bore 34 of the pump housing 32. The tapered shoulder 72 is provided with a radially-projecting face 74 which bears against the shoulder 64 during the up-stroke operation.

Figure 5:
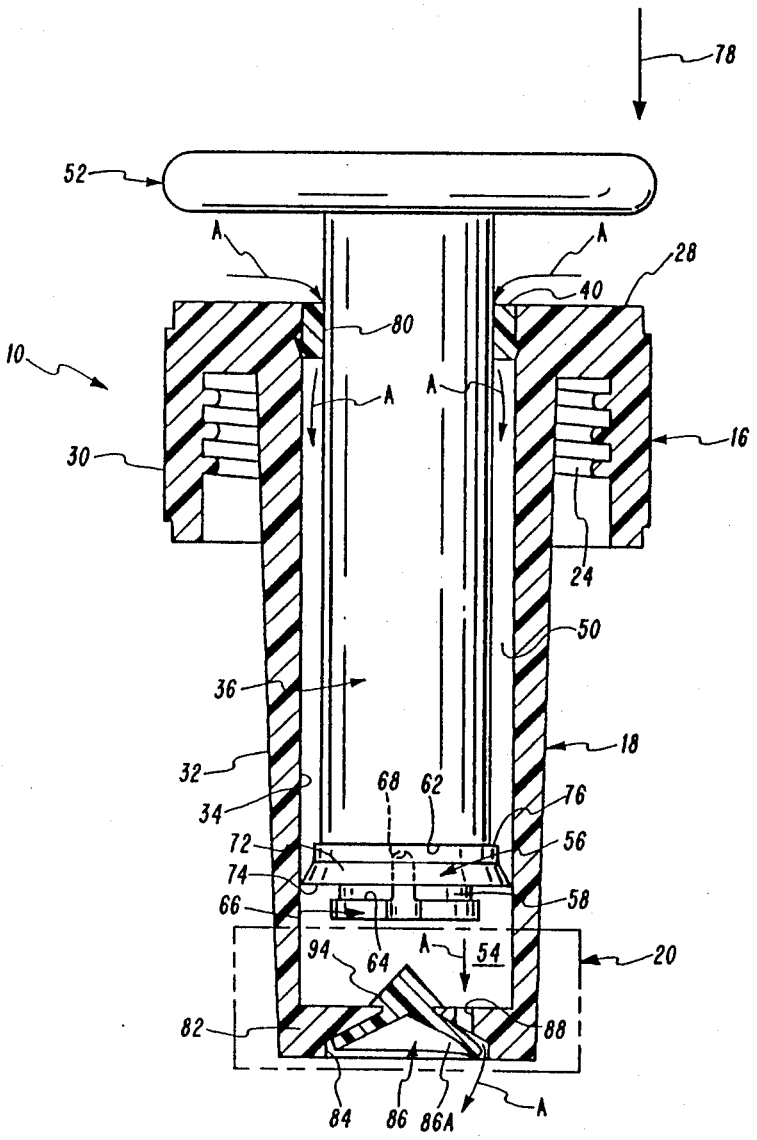

Referring now to FIG. 5, during down-stroke operation the floating annular seal 56 is forced against the radial shoulder 62, thereby sealing the air supply annulus 50 with respect to the vent passage 68. The floating annular seal 56 is provided with an annular face 76 which bears against the radial shoulder 62 in surface-to-surface engagement. The annular union between the shoulder 62 and the annular face 76, together with the seal provided by the engagement of the resilient flange 72 of the floating seal against the piston bore 34, provide a secure seal which prevents the back flow of air A out of the compression chamber 54 into the air supply annulus 50 during a down stroke as indicated by the arrow 78 in FIG. 5.

Moreover, as the piston 36 and the annular seal 56 are displaced into the piston bore 34, a low pressure condition is created in the air supply annulus 50, which draws ambient air A through the air supply annulus between the piston 36 and the locator ring 40, thus providing a new charge of ambient air A to be transferred into the compression chamber 54 as the piston is withdrawn on the next up stroke.

The annular clearance between the piston 36 and the bore 42 of the locator ring 40 is too small to illustrate clearly and is shown only as a line 80 in FIGS. 4 and 5.

Referring again to FIG. 3, the pump housing 32 is sealed by the check valve assembly 20 which is formed on the lower end of the pump housing 32. The chamber 54 is closed by a web 82 which is integrally formed with the pump housing 32. A valve pocket 84 extends axially into the web 82 for receiving a resilient, conformable membrane 86. In the preferred embodiment, the membrane 86 is made of resilient polymer material which assumes the form of a flat disk when unloaded.

A discharge port is provided by a small bore 88 which extends through the web 82, thereby providing a passage for the flow of air out of the compression chamber 44 and into the container interior open space 22.

According to a preferred aspect of the invention, the pocket 84 is enlarged by a tapered bore 90 which extends through the web 82. The apex of the tapered bore 90 is truncated along its line of intersection with the boundary of the compression chamber 54. The intersection of the tapered bore 90 with the compression chamber 54 defines an opening 92 in which a conical fastener portion 94 of the resilient membrane 86 is received.

In particular, the resilient membrane 86 is attached to a resilient, conical fastener 94 which is inserted through the opening 92. The retainer cone 94 is fabricated of a resilient material which resumes its fully expanded configuration after being forced through the opening 92. As the fastener 94 is pushed through the opening 92, the resilient membrane disc 86 is caused to deflect and engage the conical bore 90 as illustrated in FIGS. 4 and 5.

As a result of the resilient flexure of the membrane disc 86 against the tapered sealing surface 90, the forces directed onto the membrane during an up-stroke operation, as shown in FIG. 4, and at rest, are uniformly distributed across the face of the membrane, thereby avoiding the creation of wrinkles which could compromise the seal.

During a down-stroke operation as illustrated in Figure 5, the resilient membrane 86 is easily displaced by the compressed air A away from the tapered surface 90 which surrounds the discharge port 88, thereby permitting the flow of compressed air A from the compression chamber 54 through the bore 88 and into the container interior space 22. The lip 86A is deflected radially inwardly and away from the web 82 in response to the force developed by the compressed air A, thereby relieving the compression chamber 54 during down-stroke movement of the piston 36.

Additionally, as the floating annular seal 56 is pulled upwardly through the bore 34, a vacuum is produced in the chamber 54 which draws the lip of the resilient membrane against the tapered bore 90, thereby tightly sealing the discharge port 88.

After a portion of the carbonated beverage 14 has been served from the container 12, the factory installed closure cap is discarded and the container 12 is sealed by the closure cap/pump combination 10 by inserting the pump 18 through the neck 26 of the container and twisting the closure cap 16 to tightly seal the dispensing opening in the neck 26. Because a substantial portion of the carbonated beverage has been served, the interior open space 22 of the container should be pressurized to a pressure level great enough to inhibit the release of dissolved carbon dioxide from the carbonated beverage 14. This is accomplished by manually operating the pump 18 to force ambient air A into the interior open space 22 by manually reciprocating the piston 36. Upon an up stroke of the piston 36, air is transferred from the annulus 50 into the compression chamber 54 through the vent passage 68, and during a down-stroke operation, the floating annular seal 56 effectively seals the compression chamber 54, with air previously drawn into the compression chamber being forced through the discharge port 88 of the check valve 20.

Reciprocal movement of the floating annular seal 56 about the reduced diameter piston portion 58 permits the efficient charging of the compression chamber and the effective sealing of the compression chamber during a down stroke so that the desired high-pressure levels can be established within the interior open space 22 within the container 12. The resilient membrane disc 86 securely seals the discharge port 88 of the check valve 20, thereby preventing the escape of the compressed gases out of the pressurized open space 22 of the container after the desired pressure level has been achieved. The check valve is operable independently of the piston, and provides a secure seal against back flow at all times, so that it is not necessary to rotate or otherwise displace the piston 36 to secure the seal after a pumping operation has been completed.

Although the invention has been described with reference to a specific preferred embodiment, and with reference to a specific carbonated beverage container application, the foregoing description is not intended to be construed in a limiting sense. Various modifications of the preferred embodiment as well as alternative applications of the invention will be suggested to persons skilled in the art by the foregoing specification and illustrations. For example, the combination closure cap/pump assembly of the present invention can be incorporated with other air-pressurized devices in which it is desired to maintain a specific pressure level. It is therefore contemplated that the appended claims will cover any such modifications or embodiments that fall within the true scope of the invention.

What is claimed is:

1. A pressurizing and closure assembly for use in combination with a carbonated beverage container comprising:

a closure cap having a central opening;

a pump having a pump housing attached to said closure cap, said pump housing having a cylindrical bore aligned with said central opening and piston mounted for reciprocal movement through said bore, said piston having a reduced diameter portion and a vent groove formed on said reduced diameter portion;

a seal mounted on said reduced diameter piston portion for axial displacement from a first position to a second position along said reduced diameter portion, said seal defining the boundary of a compression chamber within said bore on one side of the seal, and an air supply annulus being defined between the piston and the pump cylinder bore on the other side of the seal, said seal having a resilient, annular shoulder engaging said piston bore and said piston and sealing the air supply annulus with respect to said vent groove when said seal is in the first position, and said seal being movable to the second position on said reduced diameter piston portion wherein said vent groove is in communication with the air supply annulus and the compression chamber;

a check valve coupled to said pump housing in communication with said compression chamber, said check valve having a discharge port in communication with said compression chamber and a movable valve element for covering and uncovering the discharge port;

said pump housing including a web portion in which said discharge port is formed, said web portion having a sloping sidewall defining a pocket in which said movable valve element is received, said movable check valve element comprising a flexible member coupled to said web, said flexible member resiliently engaging said sloping sidewall and covering said discharge port.

2. A pressurizing and closure assembly as defined in claim 1, said sloping sidewall defining a conical valve seating surface within said pocket, and said discharge port comprising a bore intersecting said web and said conical seating surface.

3. A pressurizing and closure assembly as defined in claim 1, said flexible member comprising disc of resilient material.

4. A pressurizing and closure assembly for use in combination with a carbonated beverage container comprising:

a closure cap having a central opening;

a pump having a pump housing attached to said closure cap, said pump housing having a cylindrical bore aligned with said central opening and a piston mounted for extension and retraction through said bore;

an annular seal mounted on said piston, said seal engaging said bore and defining the boundary of a compression chamber within said bore on one side of said seal and an air supply annulus being defined between the piston and the pump cylinder bore on the other side of the seal;

valve means coupled to said piston for connecting and disconnecting said air supply annulus in fluid communication with said compression chamber in response to reciprocal movement of said piston;

a check valve coupled to said pump housing in communication with said compression chamber, said check valve having a discharge port in communication with said compression chamber and a movable valve element for covering and uncovering the discharge port; and, said pump housing having a portion defining a pocket in which said discharge port is formed and in which said movable valve element is received, said movable check valve element comprising a flexible member coupled to said housing, said flexible member resiliently engaging said pocket portion and covering said discharge port.

5. A pressurizing and closure assembly as defined in claim 4, said pocket portion defining a conical valve seating surface within said pocket, and said discharge port comprising a bore intersecting said web and said conical seating surface.

6. A pressurizing and closure assembly as defined in claim 4, said flexible member comprising disc of resilient material.

* * * * *